US005767881A

United States Patent [19]

Geissmann

[11] Patent Number: 5,767,881

[45] Date of Patent: Jun. 16, 1998

[54] PRINT HEAD FOR AN INK JET PRINTER

[75] Inventor: Jürg Geissmann, Zurich, Switzerland

[73] Assignee: Pelikan Produktions AG, Egg Bei Zurich, Switzerland

[21] Appl. No.: 646,627

[22] Filed: May 8, 1996

[30] Foreign Application Priority Data

May 10, 1995 [DE] Germany ..... 295 07 743.3

[51] Int. Cl.[6] ..... B41J 2/175

[52] U.S. Cl. ..... 347/86; 347/87

[58] Field of Search ..... 347/85, 86, 87

[56] References Cited

U.S. PATENT DOCUMENTS 5,467,118 11/1995 Gragg et al. ..... 347/87
5,594,483 1/1997 Kaplinsky et al. .

FOREIGN PATENT DOCUMENTS

0603504A1 10/1993 European Pat. Off. .
0605183A2 12/1993 European Pat. Off. .
0645244A1 5/1994 European Pat. Off. .
0 623 444 A1 11/1994 European Pat. Off. .
647527 4/1995 European Pat. Off. ..... 347/86
94057623 U 4/1994 Germany .

*Primary Examiner*—N. Le
*Assistant Examiner*—Thinh Nguyen
*Attorney, Agent, or Firm*—Fay, Sharpe, Beall, Fagan, Minnich & McKee

[57] ABSTRACT

A print head for an ink-jet printer comprises a housing having an exterior wall in which is carried a jet plate having ink ejection outlets. A wall in the housing defines an interior chamber having at least one side formed by a screen. A first flow passage leads from the interior of the chamber to the jet plate. Overlying the screen on the side of the screen external to the interior chamber is a connection including a tubular element having an inlet end with a porous sealing element for connection with an ink cartridge. A sealing ring surrounds the inlet end. The connection further includes a second flow passage for conducting ink from the inlet end through the interior of the tubular element to the screen external to the interior chamber.

8 Claims, 6 Drawing Sheets

PRINT HEAD FOR AN INK JET PRINTER

The subject invention is directed to the art of print heads and, more particularly, to a print head with an exchangeable ink cartridge.

Print heads are commercially available which have at one housing wall a jet plate with a multitude of jets. The jet canals communicate with a chamber which is closed off on two opposing sides by means of screens. The screens prevent the penetration of particles when ink flows into the jet canals from the ink reservoir in the housing. These commercially available print heads are disposable items, which are discarded after consumption of the ink supply. Operation of these print heads is therefore relatively expensive.

On the other hand, from European Patent A-560 729 a print head is known with an exchangeable ink cartridge. Consequently, the expensive parts, namely the jet plate with the electrical components can be used several times. This results in a more cost-friendly operation. The ink cartridges described in European Patent A-560 729, however, cannot be employed with the initially mentioned print heads.

The object of the present invention is to design a print head of the initially mentioned type in such manner that it is suitable for exchangeable ink cartridges. This task is solved by means of the combination of characteristics of the claims. In the following, exemplary embodiments of the invention are explained by means of the drawings, wherein:

Figure 1:
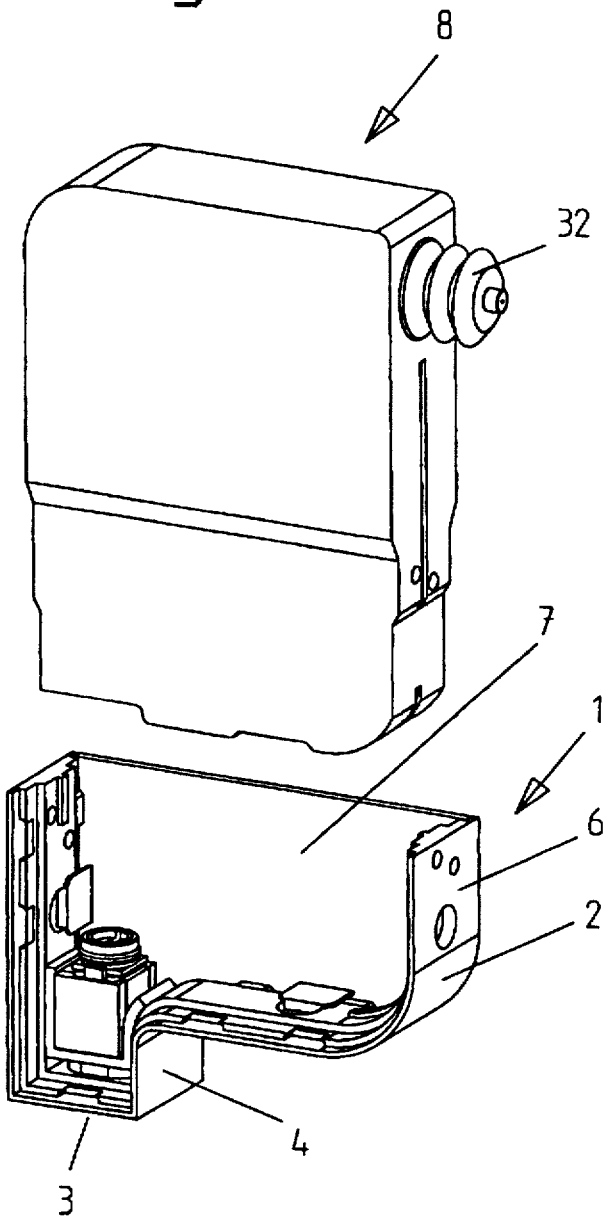
FIG. 1 shows a perspective representation of a print head with an ink cartridge.
Figure 2:
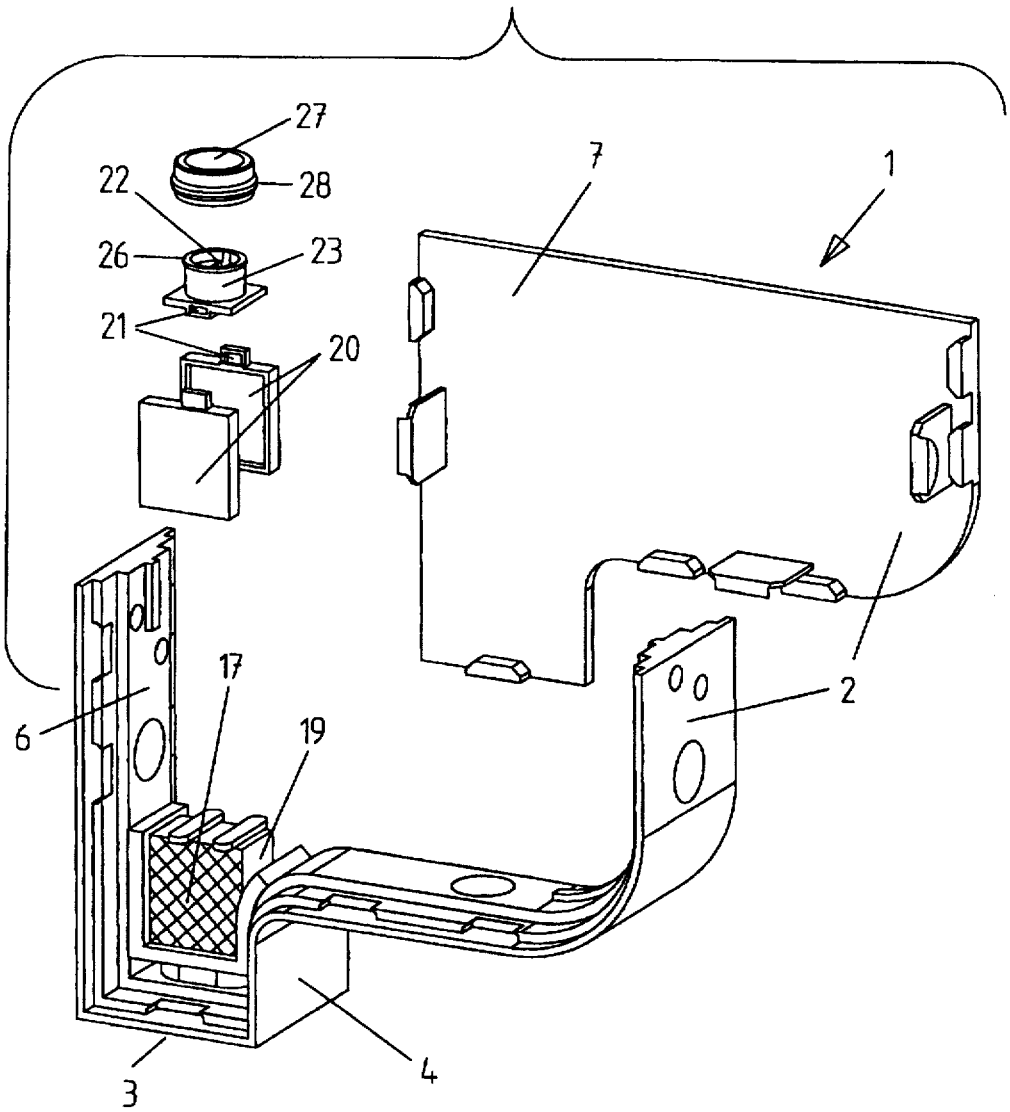
FIG. 2 shows a perspective representation of the individual elements of the print head.
Figure 3:
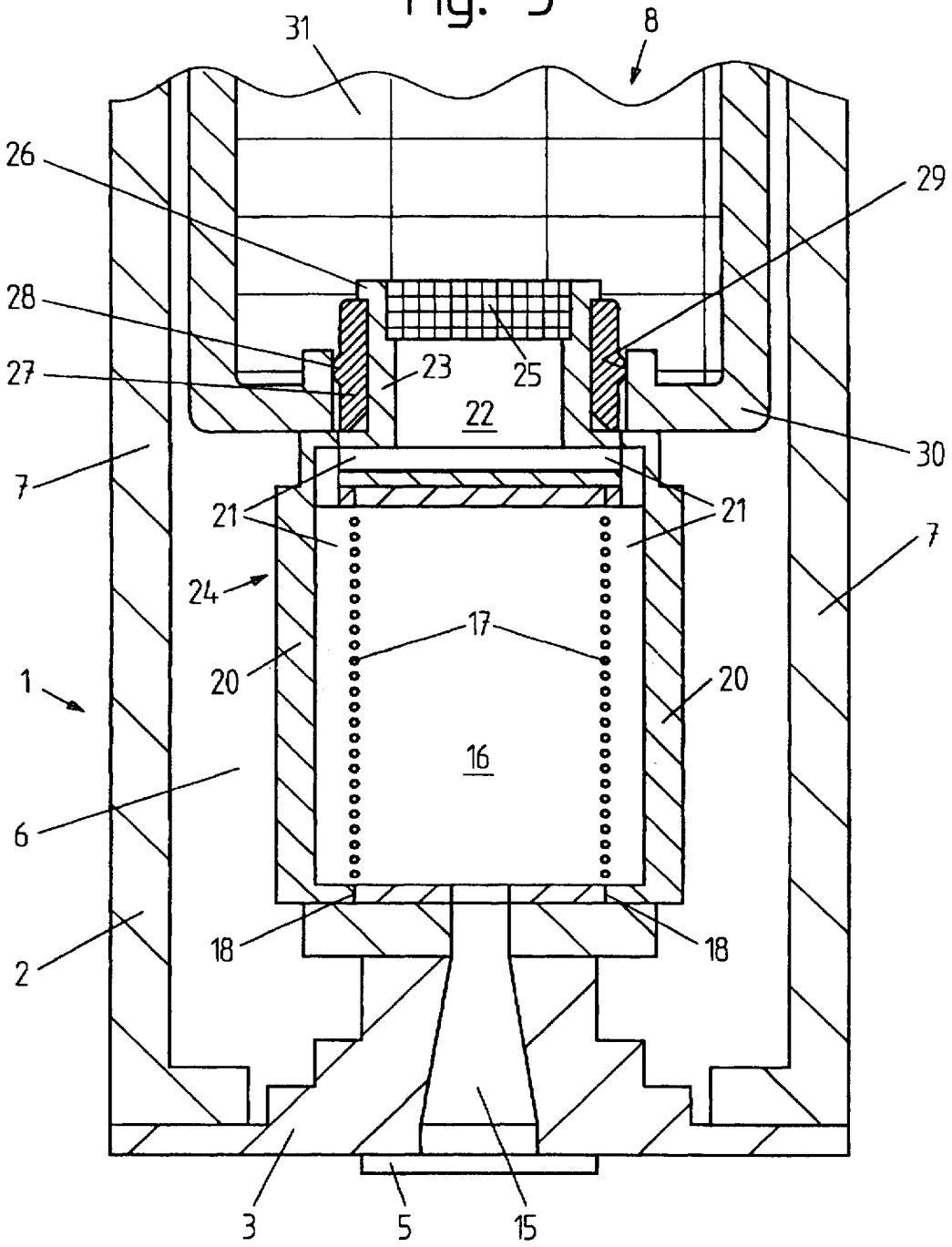
FIG. 3 shows a section through the lower part of the print head with inserted ink cartridge.

Referring now to the drawings wherein the showings are for the purpose of illustrating the preferred embodiments of the invention only and not for the purpose of limiting same, FIGS. 1 to 3 shows a print head 1 as comprising a housing 2 which has at the front surface 3 a square projection 4 that carries a jet plate 5 with a multitude of jets (not shown). The housing 2 has a lateral wall 6 on which there is fastened a lid 7 on one side or on both sides (in FIGS. 1 and 2, the one lid is not shown). The housing 2 is open at the top for acceptance of an ink cartridge 8.

The jet canals of the jet plate 5 communicate via a canal 15 with a chamber 16, which is closed off by means of two close-meshed screens 17 on two spaced and opposed, parallel sides. On the front surfaces 18 of chamber wall 19, on which the screens 17 are fastened, there are also welded or bonded two connection plates 20. The plates 20 each have an additional canal 21, which joins the side of the screens 17 facing away from chamber 16 with the bore 22 of a tube-shaped connection piece 23.

The connection piece 23 forms with the plates 20 a connection element 24. The bore 22 is sealed at the upper end by a porous body 25, for example by a close-meshed screen or a sintered body. The flat frontal surface of the body 25 is arranged vertically vis-a-vis the surface of the screens 17. The capillarity of the body 25 is greater than the capillarity of the jets of the jet plate 5. The connection piece 23 has at its free end a collar 26, which holds a sleeve-shaped sealing ring 27 with a sealing bead 28 positively locked on the connection piece 23. The ring 27 acts as a seal against a bore 29 in a wall 30 of the cartridge 8. The cartridge 8 is filled with an ink-soaked foam body 31. Alternatively, the cartridge 8 can also hold free ink and be equipped with a pressure equalizing system. It has at its upper end an air pump 32, in order to facilitate start-up after replacement of cartridge 8.

As a result of the described design of print head 1, simple exchange is made possible of ink cartridge 8 after consumption of its ink supply. As a result of the high capillarity of the sintering body 25, it is achieved that with depletion of the ink supply of ink cartridge 8, the chamber 16 and the canals 15, 21, as well as the bore 22, remain filled with ink, because no air can be aspired through the body 25. This facilitates initiation of operation following insertion of a new cartridge 8. As a result of the combination of the sintering body 25 together with the screens 17, it is guaranteed that the narrow jet canals and the jets of the jet plate 5 cannot be clogged.

Figure 4:
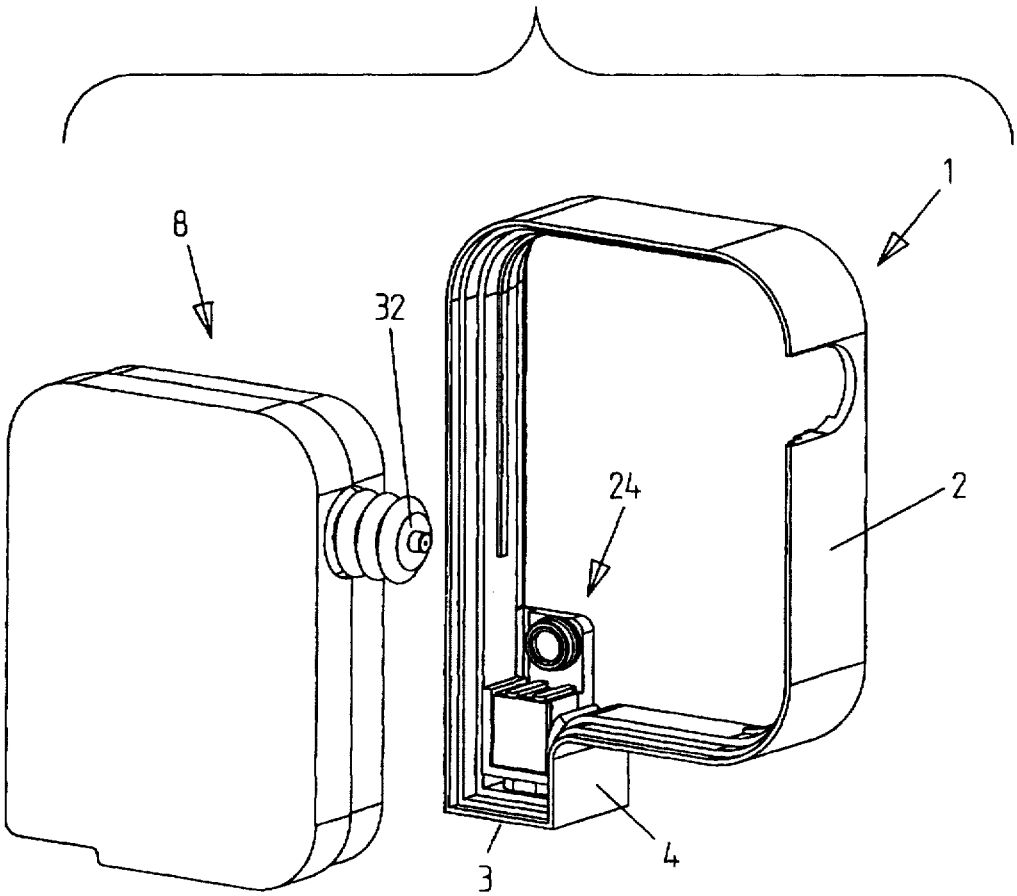
FIG. 4 is a view like FIG. 1 showing a second embodiment.
Figure 5:
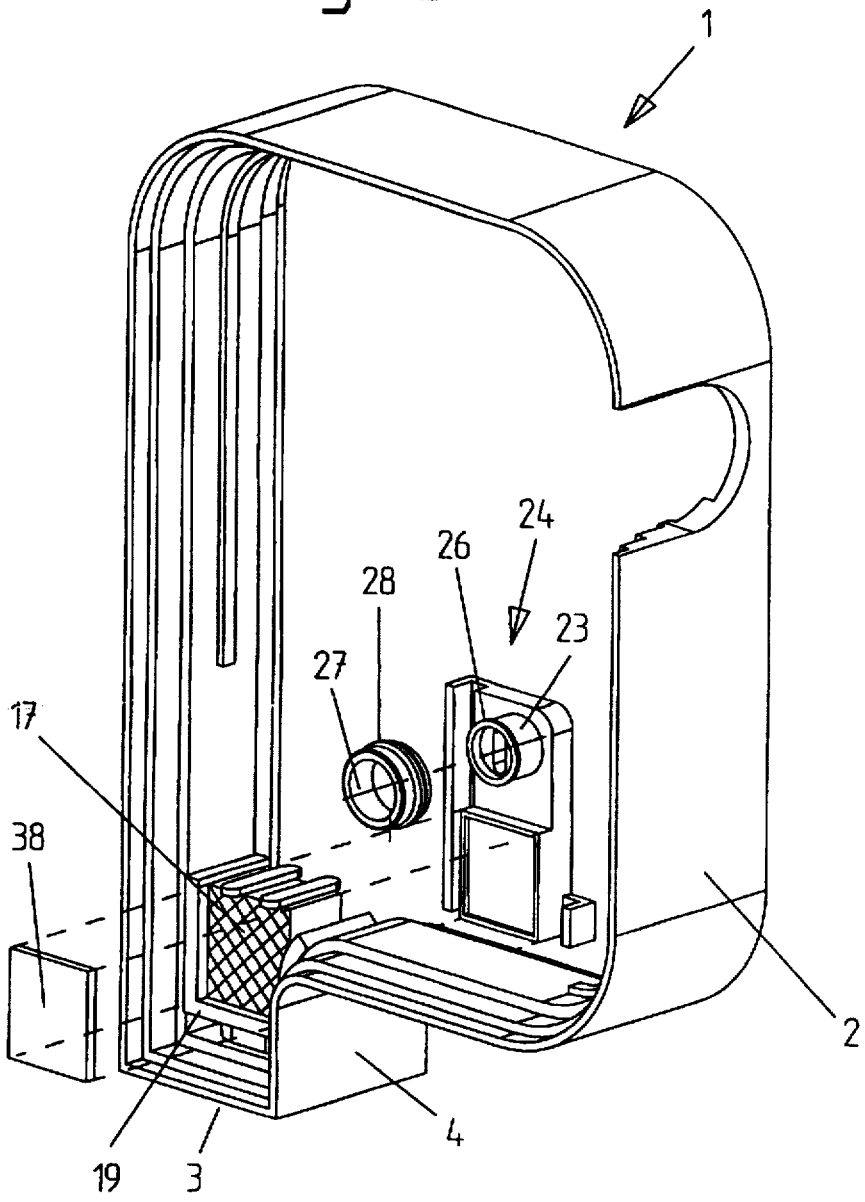
FIGS. 5 and 6 are views like FIGS. 2 and 3, respectively, showing the embodiment of FIG. 4.
Figure 6:
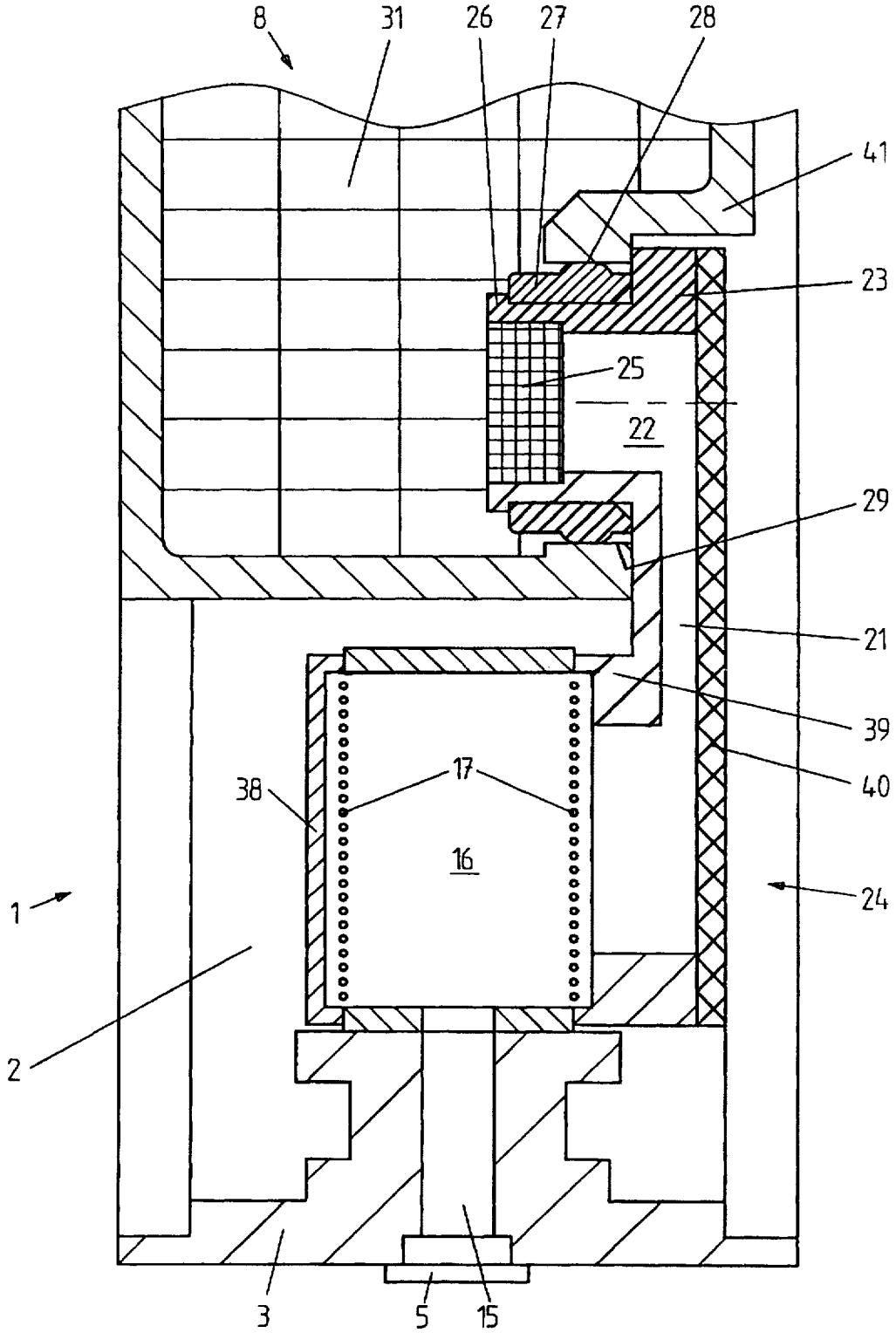

In the specific embodiment according to FIGS. 4–6, components similar to those described with respect to the FIGS. 1–3 embodiment are given identical reference symbols, and the prior description of such correspondingly numbered components is to be considered applicable unless otherwise noted.

The specific embodiment according to FIGS. 4–6 differs mainly from that according to FIGS. 1–3 in that the housing 2 of print head 1 is open on the side instead of at the top and that the ink cartridge is inserted laterally. The connection element 24 is welded or bonded on only one side of the chamber wall 19./ The other screen 17 is closed off by a lid 38. The frontal surface of the tube-shaped connection piece 23 is parallel to the plane of the screens 17. The element 24 is comprised of a sealed-on connection body 39, onto which the connection piece 23 is formed in one piece, and a lid 40. In this specific embodiment, the bore 29 of the cartridge 8 is arranged in the side wall 41 of cartridge 8.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is claimed:

1. A print head for an ink-let printer comprising:

a housing having an exterior wall carrying a jet plate having ink ejection outlets;

wall means in the housing defining an interior chamber having at least one side formed by a screen;

a first flow passage leading from the interior chamber to the let plate; and, a connection means connected to the wall means overlying the screen on a side of the screen external to the interior chamber, said connection means including a tubular element having an inlet end for connection with a replaceable ink cartridge, a reusable sealing ring surrounding said inlet end such that the inlet end being adapted for repeated sealing connection and disconnection with the replaceable ink cartridge, said connection means further including a second flow passage for conducting ink from the inlet end through an interior of the tubular element to the screen external to the interior chamber wherein the screen is flat and the connection means includes a flat frontal surface arranged vertically relative to a plane surface of the screen.

2. The print head according to claim 1 wherein the sealing element having a capillarity which is greater than a capillarity of the ink ejection outlets of the jet plate.

3. The print head according to claim 1, wherein the flat frontal surface of the connection means is arranged parallel to the plane surface of the screen.

4. The print head according to claim 1 wherein the interior chamber includes two opposing sides each having a separate screen and wherein the second flow passage provides fluid communication from the tubular element to each of said separate screens.

5. The print head according to claim 1 wherein the sealing ring is formed from an elastomer and is formed lockingly affixed on the tubular element.

6. The print head according to claim 5 wherein the elastomer is a silicone rubber.

7. A method of converting a print head including an enclosed ink chamber containing ink into a print head connectable with a replaceable ink cartridge, wherein the enclosed ink chamber includes an ink outlet port being in fluid communication with the print head to supply ink from the ink chamber to the print head and further including a screen disposed across the ink outlet port, the method comprising the steps of:

removing a portion of the enclosed ink chamber to provide access to an interior of the enclosed ink chamber;

connecting a connector element to the ink outlet port enclosing the screen and the outlet port, the connector element including a tubular element projecting therefrom, the connector element defining an ink flow passage from the tubular element to the screen; and providing a sealing ring peripherally disposed around the tubular element for selectively connecting and disconnecting a replaceable ink cartridge to the tubular element and forming a fluid tight seal with a connected replaceable ink cartridge.

8. A method of converting a non-connectable print head which can not connect with a replaceable ink cartridge into a connectable print head connectable with a replaceable ink cartridge, wherein the non-connectable print head includes an enclosed ink chamber containing ink and includes an ink port disposed between the enclosed ink chamber and the non-connectable print head to supply ink from the enclosed ink chamber to the non-connectable print head, the method comprising the steps of:

removing a portion of the enclosed ink chamber to provide access to an interior wall of the enclosed ink chamber;

connecting a connector element, which includes a tubular element projecting therefrom, to a portion of the interior wall of the enclosed ink chamber, the connector element enclosing the ink port and defining an ink flow passage from the tubular element to the ink port; and providing a sealing ring peripherally disposed around the tubular element for selectively connecting and disconnecting a replaceable ink cartridge to the tubular element which forms a fluid tight seal with a connected replaceable ink cartridge such that the non-connectable print head becomes a connectable printhead connectable to a replacement ink cartridge.

* * * * *